US006944962B2

(12) United States Patent
Tessel et al.

(10) Patent No.: US 6,944,962 B2
(45) Date of Patent: Sep. 20, 2005

(54) LINE-MARKING DEVICE WITH POSITIONING DEVICES AND TRIGGER ACTIVATOR

(75) Inventors: David Tessel, Bronx, NY (US); Gerald G. Umbro, Rhinebeck, NY (US)

(73) Assignee: Umbro LLC, Rhinebeck, NY (US)

( * ) Notice: Subject to any disclaimer, the term of this patent is extended or adjusted under 35 U.S.C. 154(b) by 0 days.

(21) Appl. No.: 10/421,553

(22) Filed: Apr. 23, 2003

(65) Prior Publication Data

US 2004/0211074 A1 Oct. 28, 2004

(51) Int. Cl.[7] ..... B44D 3/38
(52) U.S. Cl. ..... 33/414
(58) Field of Search ..... 33/413, 414, 756, 33/757, 761

(56) References Cited

U.S. PATENT DOCUMENTS

| | | | | | |
|---|---|---|---|---|---|
| 3,662,471 | A | | 5/1972 | Lynde | |
| 3,942,252 | A | | 3/1976 | Roach et al. | |
| D245,235 | S | | 8/1977 | Hurwitz | |
| 4,111,564 | A | | 9/1978 | Trice, Jr. | |
| 4,189,844 | A | * | 2/1980 | Riggins, Sr. | 33/414 |
| 4,358,898 | A | | 11/1982 | Johnson | |
| 4,438,538 | A | | 3/1984 | Larsen | |
| 4,451,993 | A | | 6/1984 | Yauk | |
| 4,481,720 | A | | 11/1984 | Sury | |
| 4,624,054 | A | | 11/1986 | Edwards | |
| 4,679,325 | A | | 7/1987 | Sweatman | |
| 4,736,524 | A | | 4/1988 | King | |
| 4,790,072 | A | | 12/1988 | Edwards | |
| 4,819,337 | A | | 4/1989 | Noyes | |
| 4,993,160 | A | | 2/1991 | Fraley | |
| D335,823 | S | | 5/1993 | Shapiro et al. | |
| D342,686 | S | | 12/1993 | Rios | |
| 5,416,978 | A | * | 5/1995 | Kaufman | 33/761 |
| 5,444,919 | A | * | 8/1995 | Alves | 33/414 |
| D363,239 | S | | 10/1995 | Spirer et al. | |
| 5,481,810 | A | | 1/1996 | Hastings et al. | |
| 5,699,622 | A | | 12/1997 | Umbro | |
| 5,713,135 | A | | 2/1998 | Acopulos | |
| 5,822,874 | A | * | 10/1998 | Nemes | 33/414 |
| 5,838,431 | A | | 11/1998 | Hara et al. | |
| D402,217 | S | | 12/1998 | Taylor | |
| 5,894,675 | A | | 4/1999 | Cericola | |
| 6,108,926 | A | | 8/2000 | Fraser et al. | |
| D438,126 | S | | 2/2001 | Pickering | |
| 6,230,416 | B1 | | 5/2001 | Trigilio | |
| 6,256,895 | B1 | | 7/2001 | Akers | |
| 6,345,448 | B1 | | 2/2002 | Chontos | |
| RE37,824 | E | * | 9/2002 | Pullen | 33/761 |
| 6,453,575 | B1 | * | 9/2002 | Hsieh | 33/761 |
| 6,789,329 | B1 | * | 9/2004 | Hester | 33/414 |
| 2001/0037579 | A1 | | 11/2001 | Akers | |
| 2001/0042315 | A1 | | 11/2001 | Dixon | |

FOREIGN PATENT DOCUMENTS

| | | |
|---|---|---|
| JP | 10156767 | 6/1998 |

* cited by examiner

*Primary Examiner*—G. Bradley Bennett
(74) *Attorney, Agent, or Firm*—Brown Raysman Millstein Felder & Steiner

(57) ABSTRACT

A line-marking device (100) includes a chalk line (200) that is held in an elongated frame (170). A worker can position and align the device, then snap the line (200) using a manually operated trigger (650) to leave a mark on a surface (530), such as a wall or floor. An adjustable level device (115) on the frame (170) can be rotated to dial a desired angle for the line. The adjustable level device (115) may be provided in an angle setting device independently of the line-marking device. A laser device (125) may be carried at the tip (120) of (or elsewhere on) the frame (170) to allow the chalk line to be aligned with a reference mark (145). Respective markings (176, 177) on edge regions of rails (171, 174) of the frame (170) may indicate an angular setting of a guide bar (500), or, a protractor (810, 810*a*) may indicate the angular setting. The guide bar (500) may be relocated facing away from the filament (200) and used as an angle finding device. A retractable tape measure (1500) carried by the device enables a worker to measure distances from the chalk line.

8 Claims, 12 Drawing Sheets

FIG. 3
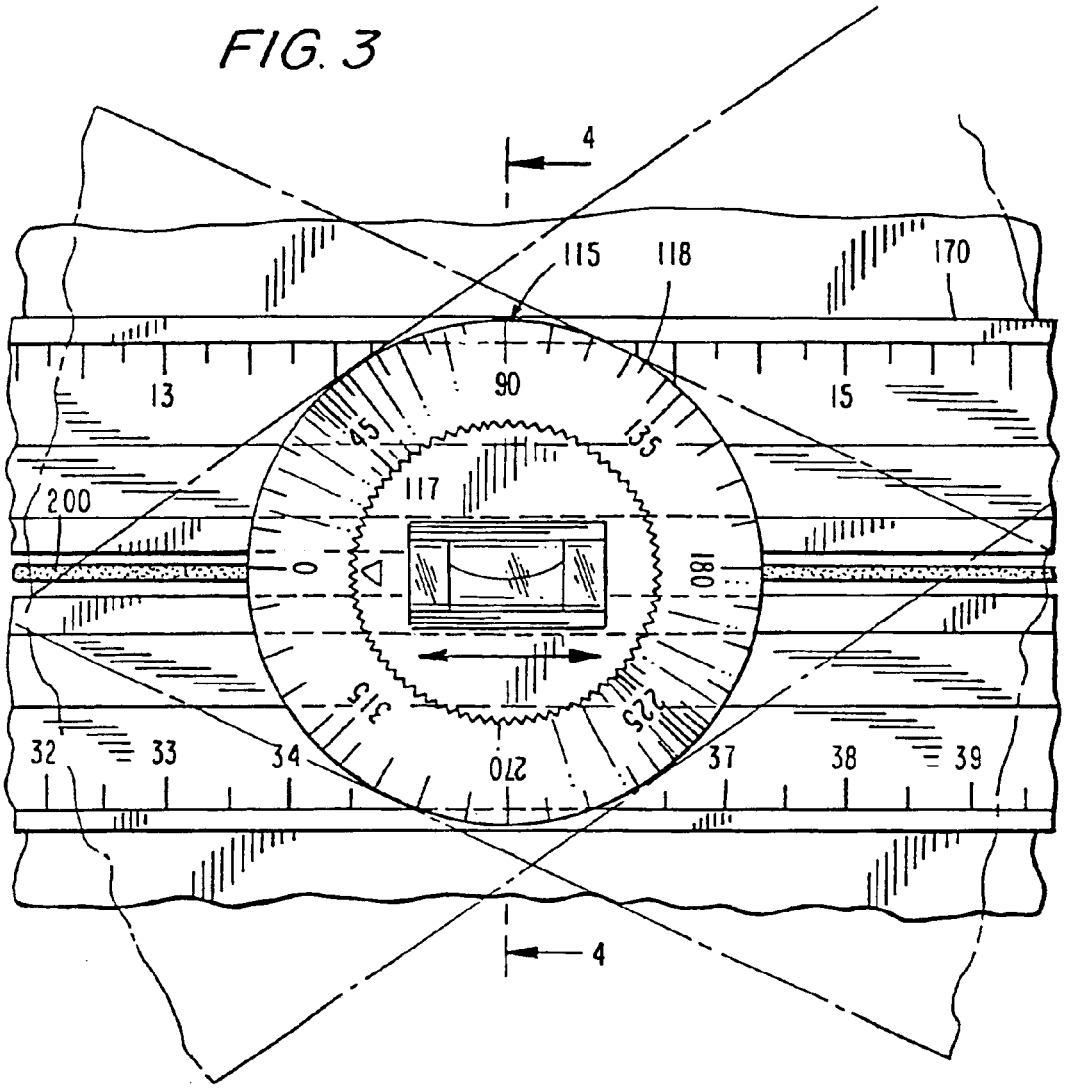
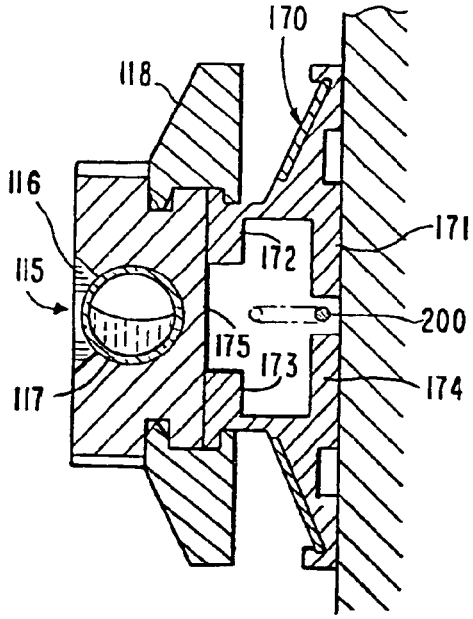
FIG. 4

FIG. 8
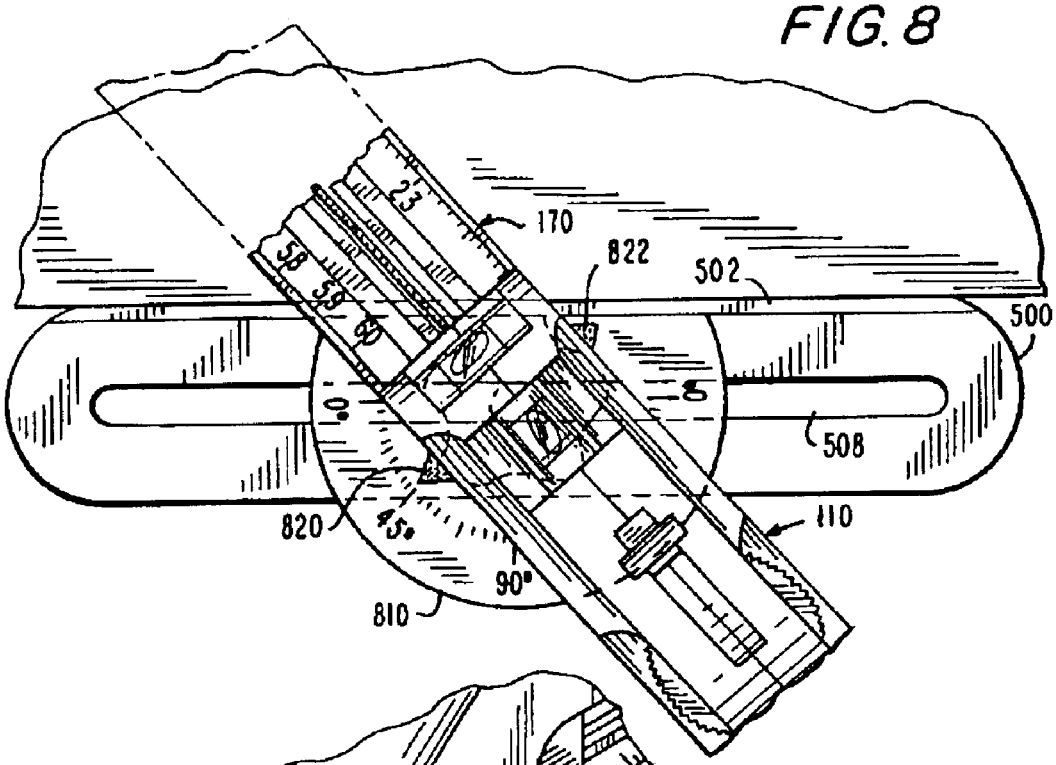
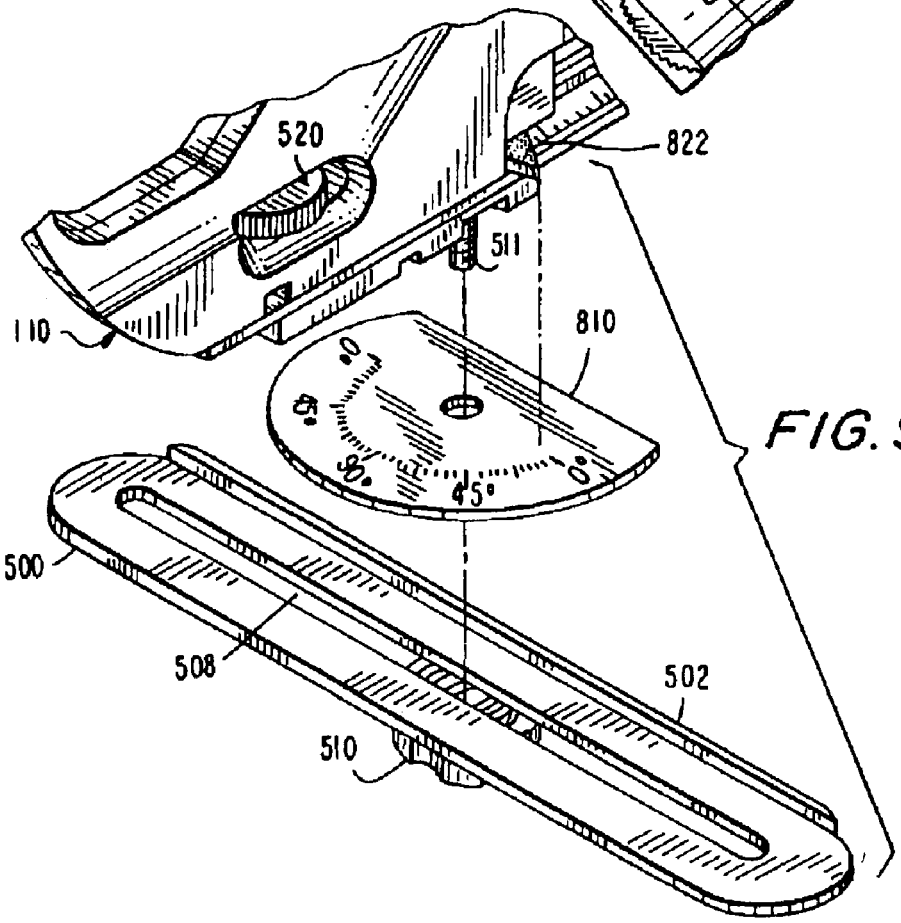
FIG. 9

FIG. 10
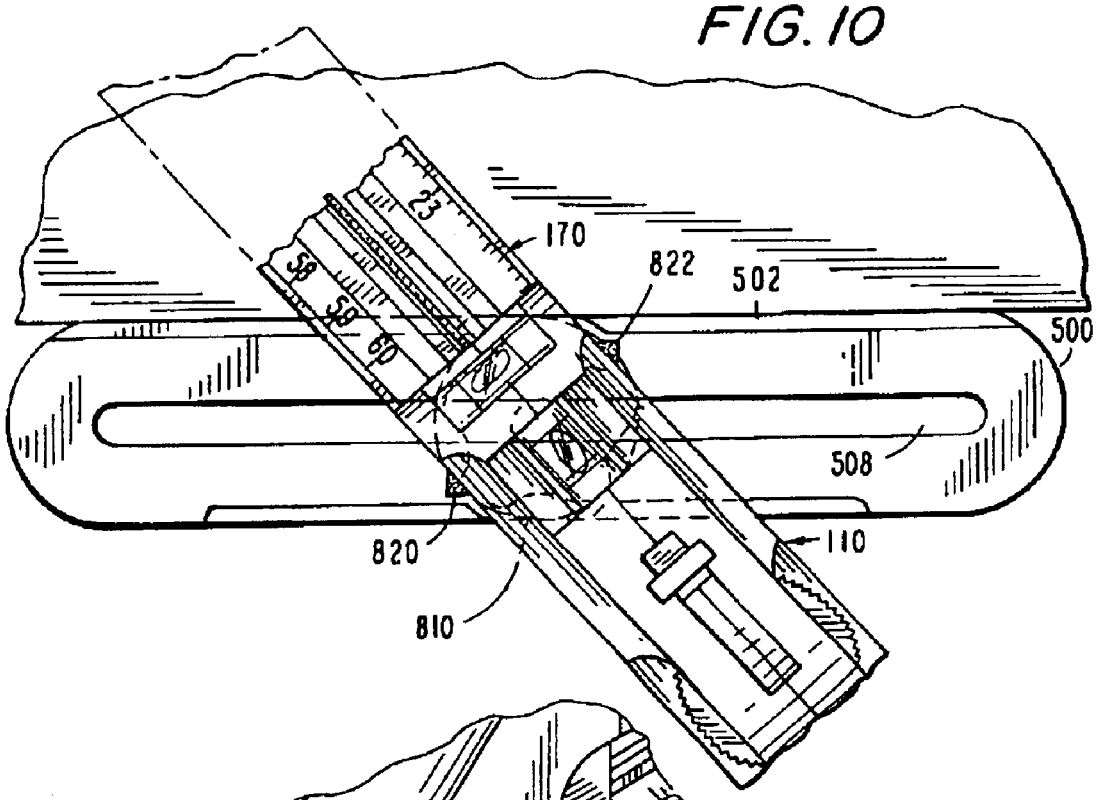
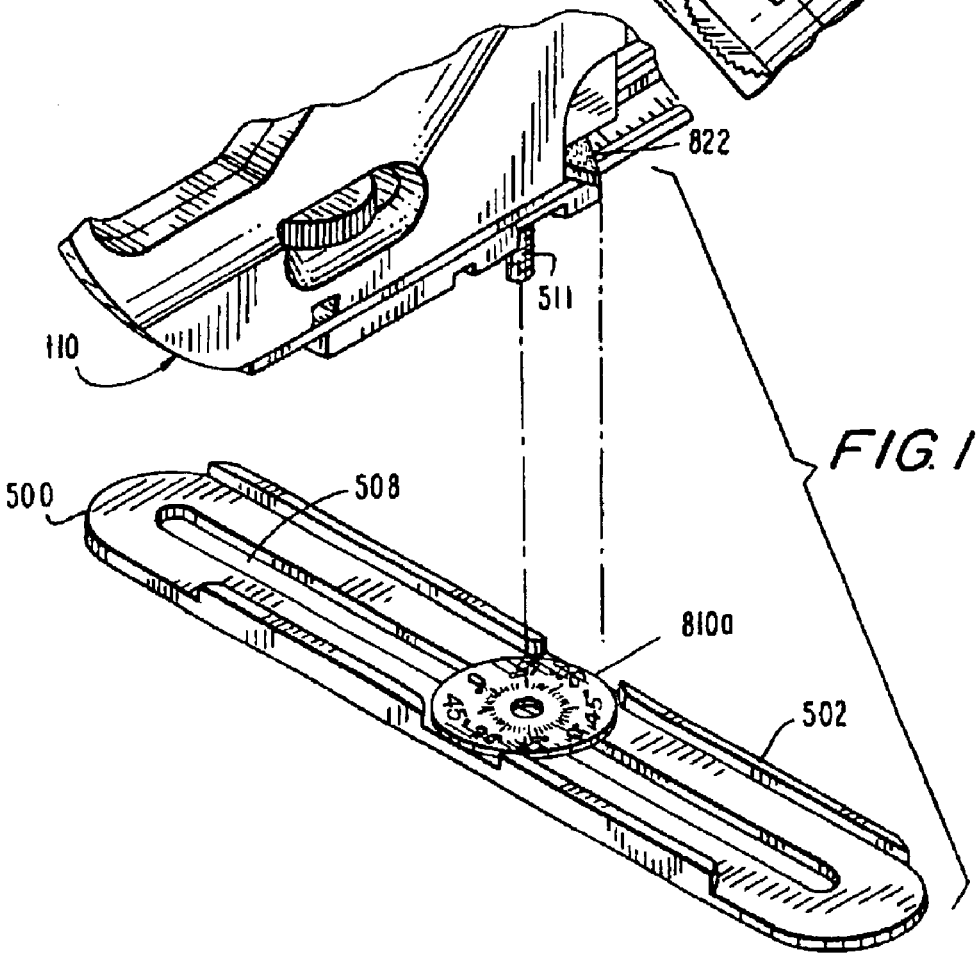
FIG. 11

FIG. 16
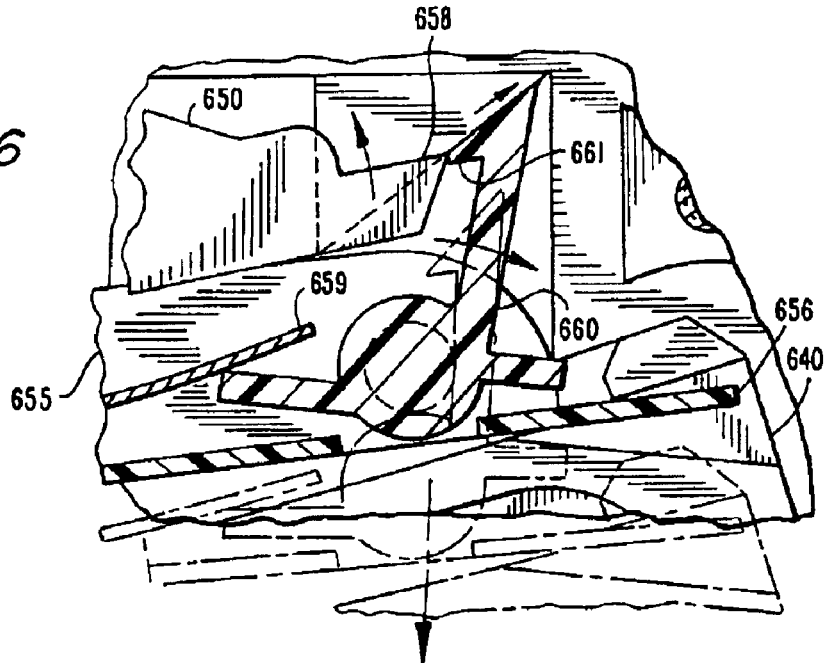
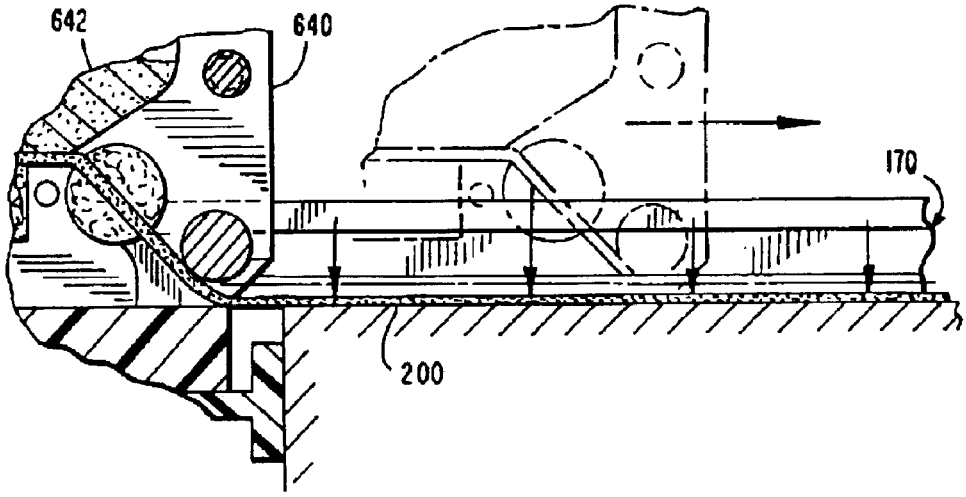
FIG. 17

LINE-MARKING DEVICE WITH POSITIONING DEVICES AND TRIGGER ACTIVATOR

BACKGROUND OF THE INVENTION

The present invention relates to a hand-held device for marking a chalk line for use in construction, home improvement and the like.

Conventional chalk line-marking devices employ a chalk line that is wound up around a spool within a case. During use, the chalk line is extended and held taut near the surface to be marked. Typically, this requires two workers—one to hold the end of the chalk line and one to hold the case. The line is then grasped and released by one of the workers so that it snaps back toward the surface, thereby depositing a chalk line. Or, one worker may devise a way to secure one end of the line using a weight or the like. In any event, the procedure is inconvenient. A handle is attached to the spool to allow the line to be wound back into the case after use.

U.S. Pat. No. 5,699,622, issued Dec. 23, 1997 to Gerald G. Umbro, entitled "Line Marking Device," describes a device usable by one person that includes a marking filament loaded with marking powder that is snapped from one end of the device. The disclosure of U.S. Pat. No. 5,699,622 is incorporated herein by reference.

SUMMARY OF THE INVENTION

A line-marking device according to embodiments of the invention allows the worker (or user) to easily and accurately position and mark a line in a desired location on a wall, floor or other surface, for example, with respect to a reference such as a line or point, etc., located spaced from the location at which the desired line is to be marked, and/or at an angle with respect to the vertical, horizontal or a reference, and/or at a desired distance from a reference, etc. The invention also provides, a trigger mechanism for snapping a marking filament of the marking device against the surface to be marked. The device is particularly useful for amateur and professional carpenters, kitchen cabinet installers, tile setters and so forth.

The line-marking device comprises an elongated frame and a filament or a cord held taut in and/or by the frame which can be activated, e.g., snapped, to apply a line to a surface adjacent the filament at a desired location. In the preferred embodiments, the marking device also includes one or more devices which can be used to position the marking device and/or the filament in a given relationship with a reference (line or point). Such devices include: a laser or other optical sighting device which can be used in the positioning of the marking device and/or the filament in a given relationship to a reference that is displaced from the location at which the line is to be applied; a level which can be used in the angular positioning of the marking device and/or filament with respect to a reference; a protractor which can be used in the angular positioning of the marking device and/or filament with respect to a reference; a distance measuring device such as a mechanical or electronic tape measure or self-supporting strip which can be used in the positioning of the marking device and/or filament at a given distance from a reference; a guide bar that can be locked in one or more angular positions with respect to the filament preferably by a stop or detent mechanism. In some embodiments, these devices are removable. For example, a marking device may be provided with a holder for a tape measure, rather than the tape measure itself, which may be provided independently of the marking device to be placed in the holder when use thereof is desired. Similarly, structure may be provided for mounting a removable protractor or level.

In one embodiment, a self-supporting member or strip with distance notation thereon may be mounted to the device to be displaceable relative thereto to be used in the positioning of the marking device and/or filament at a given distance from a reference. In this embodiment, use of the device with one hand is facilitated because, unlike a tape which is prone to sagging and bending, the self-supporting member can be maintained in a straight position. Also, the self-supporting member may be fixed and used for repetitive measurements without having to retract and extend it. As an aid to this use, a tab is appended flush with the end of the self-supporting member so that when such member rests against the surface being measured, the tab abuts an end of such surface.

In a preferred embodiment, the marking device is provided with a trigger mechanism which, when activated in response to a trigger-like pull or squeeze, snaps the filament to apply a line.

In one embodiment, the line-marking device includes a rotatable level device which can be used to position the line-marking device at a desired angle, set by rotating a level forming part of the rotatable level device, with respect to a reference. The level is relatively rotatably mounted with respect to the elongated frame. At least one pointer or mark is provided in a fixed relationship with the level, and at least one mark or scale is provided in a fixed relationship with the elongated frame positioned to cooperate with the pointer and mark or scale fixed relative to the frame to indicate an angular position of the marking filament, e.g., when the level is in an equilibrium state. The level device can be permanently or removably attached to the line-marking device. In another embodiment, the rotatable level device is provided on a member (e.g., a ruler, triangle, square, tool, etc., having a linear edge) for use independently of a line-marking device to mark a desired angle with respect to a reference, or to be used as an angle finder, e.g., to replicate an angle. In embodiments where the member is a tool other than the line-marking device (e.g., a power tool such as a power saw, sander, router, etc., or a hand tool such as a triangle, tape or other distance measuring device, laser sighting device, etc.), the rotatable level device can be used to set the tool to work at the set angle, to work to the set angle, or to set or reference an angle A power tool can be set to work at a selected angle or positioned to work to a set angle.

In another embodiment, the line-marking device includes at least one laser device to emit at least one laser beam in a predetermined relationship with the marking filament (e.g., parallel and aligned with the filament). In accordance with this embodiment of the invention, the laser device is located at the point of marking, i.e., at the location at which a line is to be applied, from which the emitted laser beam can be sighted on a reference displaced from the location at which a line is to be applied by the marking device in a given relationship with the reference. This is in contrast to positioning devices, e.g., levels, squares, triangles, which are used at the point of reference to emit a laser beam to the point at which a positioning mark is to be made or at which an object is to be affixed. In various embodiments, a laser device may be provided comprising one or a plurality of lasers in a fixed and/or adjustable arrangement to emit a beam or beams in various directions in relation to the filament e.g., in mutually perpendicular directions in one, two or three dimensions. The laser device can be permanently or removably attached to the line-marking device.

In another embodiment, a guide bar is provided for the marking device and pivotally secured to the elongated frame. At least one of the guide bar and elongated frame include markings which indicate an angular setting of the guide bar relative to the elongated frame (and the filament), and the guide bar is secured, at least in part, below the elongated frame so that when the elongated frame rests against the substantially planar surface, the guide bar abuts an edge of the substantially planar surface to hold the elongated frame in a position relative to the edge according to the angular setting. This structure provides a stop or stops for the guide bar at which the guide bar can be readjustably fixed or locked in one or more predetermined angular positions relative to the frame. In a preferred embodiment, a detent mechanism provides the stops.

In another embodiment, the line-marking device includes a protractor which includes first and second arms pivotably mounted to one another, where the first arm has angle markings on an edge thereof that are swept, at least in part, by an edge of the second arm when the second arm is pivoted with respect to the first arm, and an angle between the first and second arms is indicated according to a relative position of the edge of the second arm to the angle markings on the first arm. This embodiment defines a unique protractor that may also be used independently of any line-marking function, or in positioning the line-marking device to apply a line at an angle with a particular reference. This unique protractor may be permanently or removably attached to the line-marking device. The unique protractor may also be provided as a separate unit that does not attach to the line-marking device, and may be used completely independently of the line-marking device or a line-marking function.

In another embodiment, the line-marking device includes a retractable tape measure, or a holder for a retractable tape measure that can be mounted to and removed from the line-marking device. Extension of a tape from the retractable tape measure attached to or held in the holder in a predetermined relationship to the elongated frame (and the filament), e.g., parallel or perpendicular to the filament, can be used to determine a desired distance of the filament from a reference, and thereby to enable the marking of a line at such desired distance.

In another embodiment, the line-marking device includes a manually operable or actuatable trigger mechanism used to snap the filament in response to a trigger pull or squeeze action. In a preferred embodiment, the trigger mechanism comprises a manually operable trigger movable from a nominal (e.g., a rest, or home or stowed) position to a release position to pull at least a portion of the marking filament away from a nominal position thereof and release the marking filament to snap back to its nominal position when the trigger reaches its release position. In a preferred embodiment, means are provided for coupling a manually actuatable trigger of the trigger mechanism to the marking filament so that movement of the manually actuatable trigger pulls at least a portion of the marking filament away from the nominal position thereof until the trigger reaches its release position where the marking filament is released and snaps back to its nominal position to apply a line. In a preferred embodiment, the marking device includes a shuttle containing a marking substance, e.g., chalk, through which the marking filament extends, with the coupling means coupling the shuttle to the trigger so that the manually operable trigger pulls the shuttle, and with it at least a portion of the marking filament away from the nominal position of the filament, and releases the shuttle, and with it the marking filament to snap the marking filament back to its nominal position when the trigger reaches its release position.

In another embodiment, the line-marking device includes a guide bar pivotably secured to the elongated frame, and a protractor with angular markings thereon associated with the guide bar. In one embodiment, means are provided for removably securing the protractor in a fixed relationship to the guide bar to indicate an angular setting of the guide bar relative to the elongated frame. In another embodiment, the protractor is part of or integral (e.g., unitary) with the guide bar, e.g., engraved, embossed, printed, etc., on the guide bar.

The guide bar may be configured to cooperate with structure on the line-marking device to provide an angle finder that can replicate an angle in accordance with another embodiment of the invention. In this embodiment, the guide bar is mounted to the line-marking device so that it may be re-positioned from a line-marking position (as discussed above) to an angle finding position rotated 180 degrees and positioned at the end of the handle facing away from the filament, and still pivotable relative to the handle. Either the filament or a mark (indicia, etc.) on the handle aligned with the filament may be used to position the line marking device in a reference position along one edge of the angle to be found (replicated). The guide bar is then or simultaneously pivoted to extend along the other leg of the angle and the guide bar locked in this position. The guide bar in the locked position is then repositioned back to the line-marking position where it either forms the angle to be found or the complement thereof. In a preferred embodiment, the guide bar is mounted under pressure of a spring load, so that the formed angle is maintained until a holding knob can be tightened to secure the positions of the guide bar and the handle relative to each other.

The invention also provides a method for marking a line on a surface relative to a reference, comprising aiming, at the reference, a laser beam emitted from a laser device that is positioned in a predetermined relationship with a marking filament that is held taut on an elongated frame and that carries a marking substance, while holding the elongated frame against a surface and aligning the marking filament using a level that is positioned in a predetermined relationship with the marking filament, and snapping the marking filament against the surface to apply a mark thereon.

BRIEF DESCRIPTION OF THE DRAWINGS

FIG. 3 is an enlarged plan top view of the level portion of the line-marking device depicted in FIG. 2;

FIG. 4 is a cross-sectional view of the level portion of the line-marking device depicted in FIG. 2 taken along line 4—4 of FIG. 3;

FIG. 8 is a top view of a portion of a line-marking device similar to the one depicted in FIG. 5, which includes a removable protractor in accordance with another embodiment of the invention;

FIG. 9 is a partial exploded perspective view of the protractor portion of the line-marking device depicted in FIG. 8;

FIG. 10 is a top view of a portion of a line-marking device similar to the one depicted in FIG. 5, which includes a protractor as part of the marking device's guide bar in accordance with another embodiment of the invention;

FIG. 11 is a partial exploded perspective view of the portion of the line-marking device depicted in FIG. 10;

FIG. 16 is a cross-sectional view of a portion of the trigger device depicted in FIG. 5 in a release position thereof;

FIG. 17 is a cross-sectional view of a portion of the trigger device depicted in FIG. 11 showing movement of a shuttle containing a marking substance to apply the marking substance to the filament;

DETAILED DESCRIPTION OF PREFERRED EMBODIMENTS

Figure 1:
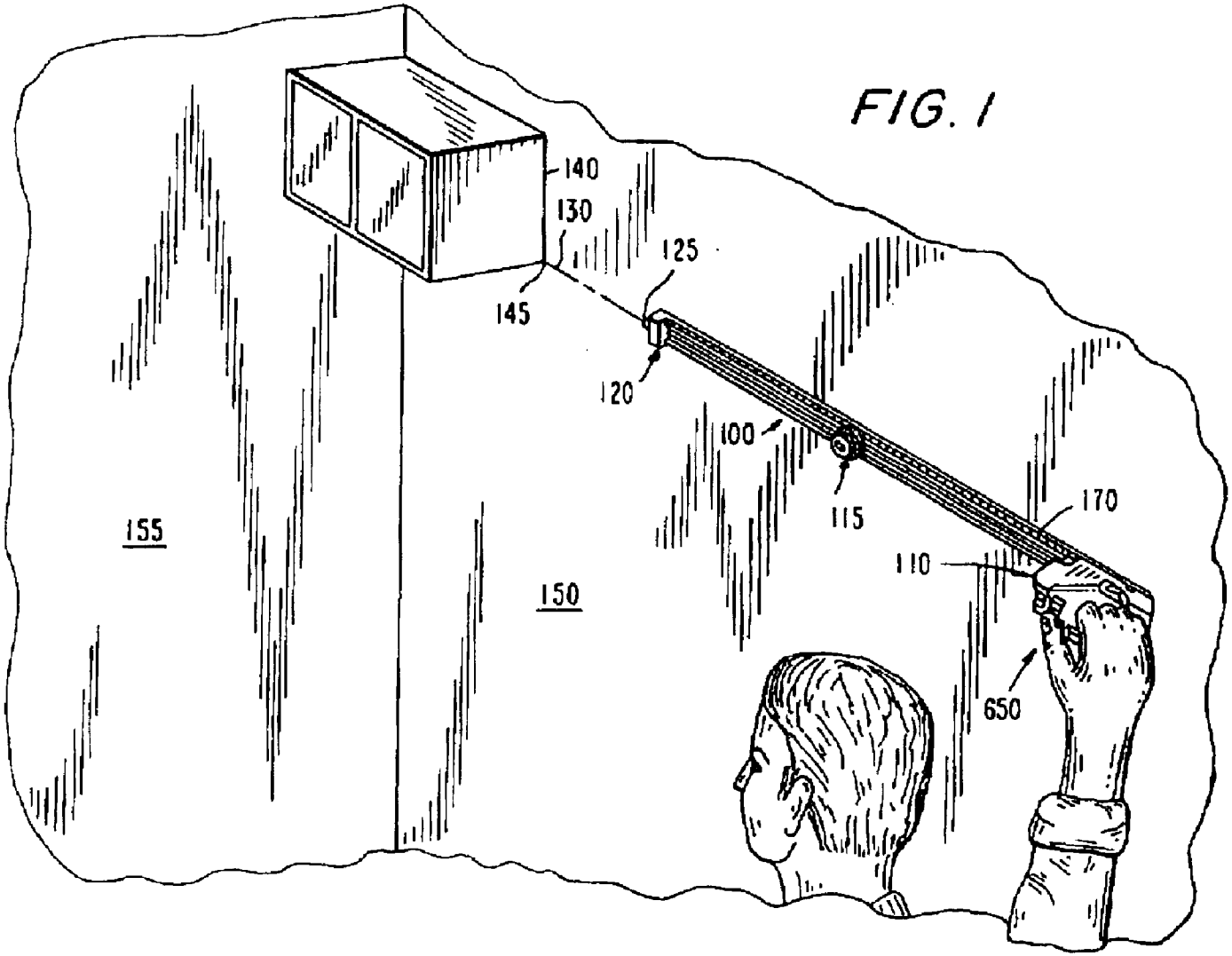
FIG. 1 illustrates a worker aligning a line-marking device, including a laser device in accordance with one embodiment of the invention, relative to a reference.

FIG. 1 depicts an embodiment of a line-marking device, shown generally at 100, that includes a laser device 125 in accordance with the invention. The line-marking device 100 may be used to apply a line on interior and exterior surfaces of construction such as drywall, panelling, plywood, concrete and the like, and on surfaces of paper, cloth, metal, plastic etc., of various items for artistic purposes and other non-technical purposes, as well as for technical and architectural purposes.

As illustrated in FIG. 1, the line-marking device 100 allows a worker to easily apply a line relative to a reference such as the bottom of a cabinet. The line-marking device 100 includes an elongated frame 170, a marking filament 200 (FIG. 2) that is held taut by the frame 170, and a handle 110 that is secured to the frame 170 to operate the line-marking device 100. Some of these components may be seen to be similar to those in the aforementioned U.S. Pat. No. 5,699,622. A laser device (referenced generally by 125 in FIGS. 1 and 19) and a level device 115 may also be provided on the line-marking device 100. The worker grips the handle 110 of the line-marking device 100 to hold it against the surface 150, and a laser beam 130 that is emitted from the laser device 125 at the tip 120 of the device is aimed at a reference mark 145. Unlike hand tools that include a laser device which are positioned at a reference location to project a laser beam to a marking location displaced from the reference location, it is the line-marking device 100 that is positioned at the marking location while a laser beam is projected to a reference location point displaced from the marking location.

The worker makes adjustments to the position of the line-marking device 100 to aim the laser beam while also referring to the level device 115 to align the marking filament 200, e.g., horizontally or at some other orientation. In this example, the reference mark 145 is at the bottom of a wall-mounted cabinet 140. Once the device 100 has been positioned such that the laser beam is aimed at the reference mark 145, and the level device 115 indicates a level orientation, the worker operates a trigger device at the handle 110 that causes a the marking filament to be tensioned away from its nominal position and released, i.e., snapped. When the filament is released, it snaps back to its nominal position and releases a marking substance such as chalk on the surface 150.

Figure 2:
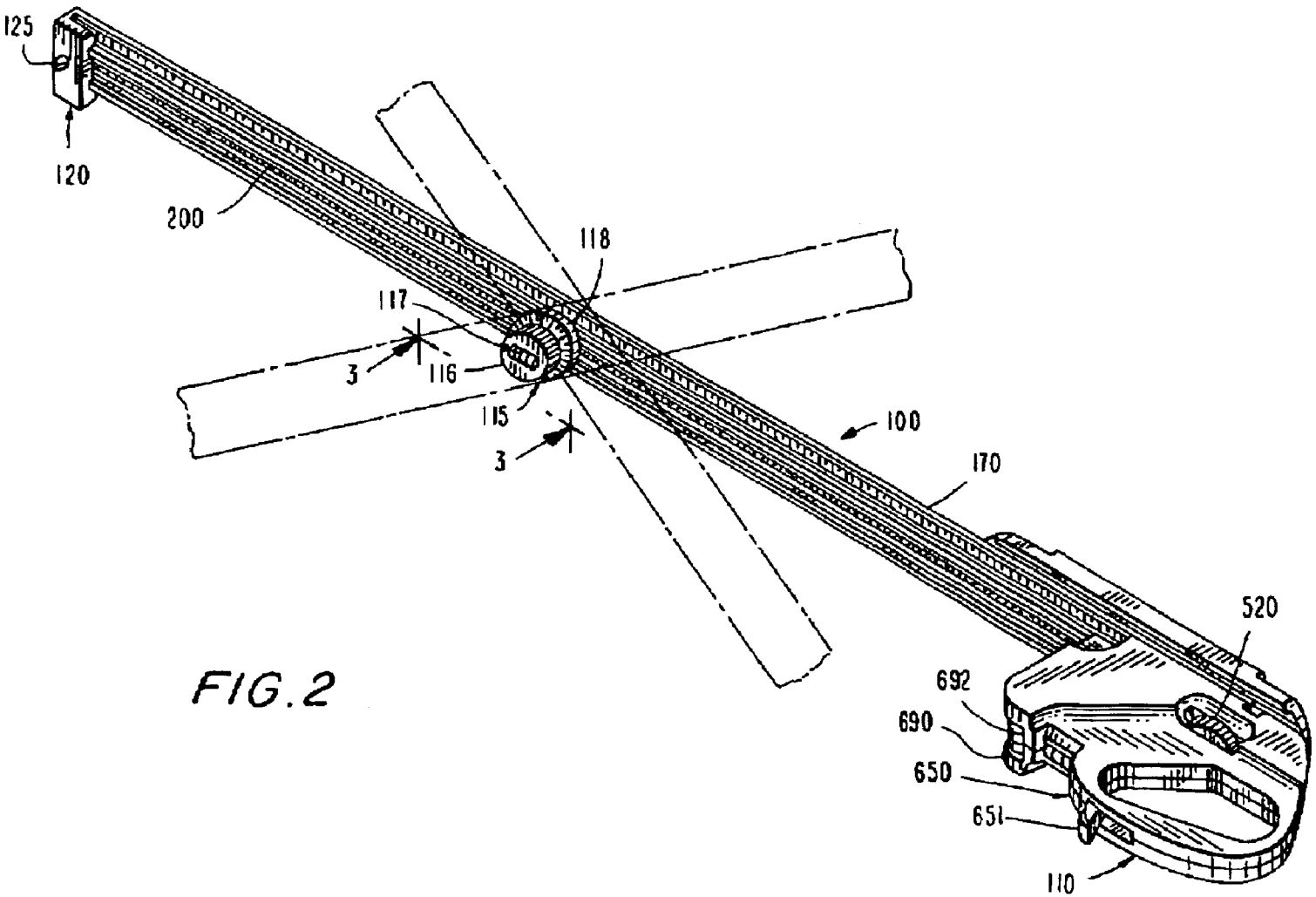
FIG. 2 is a perspective view of the line-marking device depicted in FIG. 1, which includes an adjustable, rotatable level in accordance with an embodiment of the invention.

Referring to FIGS. 2–4, the level device 115 includes a rotatable level 117. Rotation of the level 117 to a desired angle relative, e.g., to the horizontal position facilitates applying a line at the desired angle. In the position of the marking device and level depicted in FIG. 1, the level is at a home or horizontal position, and the marked line will be horizontal and at the same elevation as the reference mark 145. The line-marking device thus allows a single worker to easily and accurately mark lines on surfaces such as walls or floors. For example, lines can be marked for hanging kitchen cabinets, pictures or other wall hangings and so forth. Also, the line-marking device can translate a reference mark to different walls in a room. For instance, if the cabinet 140 was located on wall 155 but not touching the wall 150, the line-marking device can be held against the wall 155 near the corner and positioned so that the laser beam is aimed at the reference mark of the cabinet, e.g., to the left of the corner. The line can then be marked on the wall 155 near the corner. Next, the worker positions the line-marking device against the wall 150 as shown in FIG. 1 and aims the laser beam 30 at the line that was marked on wall 155, near the corner, to make a mark on wall 150. The process can be repeated to obtain constant-elevation marks on all four walls of a room. An analogous procedure can be followed to translate a reference mark vertically. For example, the line-marking device 100 can be held against the wall 150 with the laser beam 130 aimed vertically at the reference mark on a ceiling or floor. Laser devices can be provided at either or both ends of the line-marking device 100 to provide greater flexibility in marking a line in tight spaces such as corners, or laser devices may be provided to emit beams in more than one direction, as discussed below.

In an embodiment in which a laser beam may be projected in a direction other than parallel and aligned with the filament 200, e.g., perpendicular to the filament 200, the line-marking device 100 may be positioned relative to an opposing wall or the ceiling in a room, for example. In this example, a reference mark at a given height on a first wall can be translated directly to an opposite second wall or onto the ceiling or floor. The device is held flush against the second wall and its height is adjusted until the laser beam, which travels perpendicular to the second wall, is aimed at the reference mark.

The laser device 125 may include a laser diode of the type that is readily available from various vendors. One example is Quarton, Inc., Taipei Hsien, Taiwan. Such laser diodes emit a beam that is visible over long distances. The laser device 125 may be mounted at the tip 120 of the line-marking device or other location using any known technique. Batteries for the laser device 125 may be mounted at the tip 120 or other location, along with an on-off switch. For example, the batteries may be carried in the handle 110 and electrically coupled to the laser device 125 at the tip 120 via wires that are carried within the elongated frame 170 of the device 100. The laser device 25 is positioned so that one or more laser beams are emitted in a predetermined relationship with the marking filament, e.g., collinear, parallel or perpendicular to the marking filament. For example, the laser device 125 may project a beam that is collinear with the marking filament 200, or at least parallel to the filament and positioned directly above it.

Figure 19:
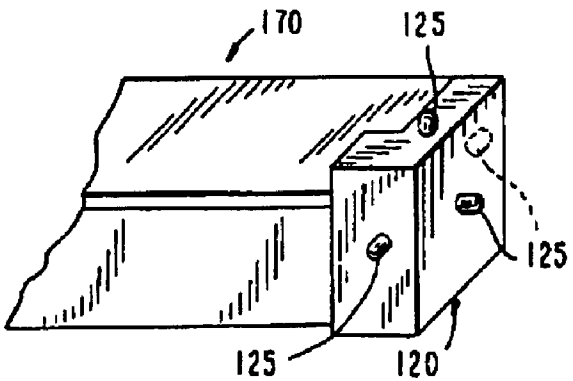
FIG. 19 is a perspective view of the end portion of a line-marking device similar to the line-marking device depicted in FIG. 1 in accordance with another embodiment of the invention, showing multiple laser devices attached to the end of the line-marking device.

In the embodiment depicted in FIG. 1, the laser device 125 comprises a single laser diode positioned to project a beam parallel to and in alignment with the filament 200. In the embodiment depicted in FIG. 2, the laser device 125 comprises a single laser diode positioned to project a beam perpendicular to and in alignment with the filament 200. In other embodiments, the laser device may comprise multiple laser devices or laser diodes, e.g., two laser devices, one as depicted in FIG. 1 and one as depicted in FIG. 2, positioned to project beams in different directions, or as shown in FIG. 19, four laser devices 125. In another embodiment, the laser device 125 depicted in FIG. 1 may be adjustable to emit a laser beam in more than one direction. Such a laser device may be of the rotary type currently used by Stabila of Germany in certain of their products. Alternatively, a single laser device 125 mounted at the end of the frame, as shown in FIG. 1, may be mounted on a ball joint so it may be rotated 90 degrees to face transversvely of the frame, and also it may be rotated 360 degrees in that plane. Channels or other structure may be provided at given angles, e.g., 0 degree, 90 degrees, 180 degrees, 270 degrees, to act as detents for the rotatable laser device. Any suitable device and/or structure may be used to mount one or more laser devices 125 to the line-marking device 100. Control circuitry, switches, batteries, etc., may be mounted in any suitable location in the frame 170 and/or the handle 110

Referring to FIGS. 3 and 4, the level device 115, discussed above with respect to FIG. 2, includes a rotatable part 116 in which is mounted a bubble level 117, and a base part 118 stationarily or longitudinally slidably mounted to the frame 170. In one embodiment, the base part 118 is slidably attached to the frame 170 (FIG. 4), and a rotatable dial part 116 is rotatably mounted to the base 118. The base part 118 is ring-shaped having a central opening configured to slidably engage the annular shoulder 172 of the frame 170, to thereby mount the base part 118 to the frame. The rotatable part 116 is disc-shaped having an outer configuration that engages shoulder 173 of the base part 118.

Various structures may be used to rotatably secure the rotatable dial part 116 to the base part 118. For example, the rotatable part 116 may be frictionally engaged with the shoulders 173 in the opening in the base part 118. Alternatively, a plug (not shown) may be stationarily affixed to base part 118 in the opening thereof, and a friction joint may be used to rotatably attach the part 116 to the plug. The base part 118 and the rotatable part 116 may be made of any suitable material, e.g., plastic or metal. An electronic level may be used in place of, or in addition to, the bubble level 117. An electronic level emits a noise or provides a flashing light or other indication when placed in a specified orientation. In one embodiment, appropriate markings may be made on the base part 118 and the rotatable part 116 to allow the worker to set the level 117 at a desired angle. The markings may be printed, embossed, or engraved, or on a decal affixed to the base part 118, for instance. For example, the base part 118 may have angle markings similar to a protractor, while the rotatable part 116 has a hash mark. Alternatively, the base part 118 may have a hash mark while the rotatable part 116 has angle markings similar to a protractor.

In either embodiment, a user may utilize the combination of the rotatable part 116, the bubble level 117 and the base part as an angle finder or replicator. The user who wishes to find or determine the angle of a surface (for the purpose, for example, of cutting a piece of wall panelling to match the angle of a non-horizontal ceiling) may press the frame 170 against the surface, and then turn the rotatable part until the bubble shows the level is horizontal. The combination of the hash mark and adjacent markings will indicate the angle of the measured surface, so that a line may be snapped using one of the methods described above/below.

Referring to FIGS. 3 and 4, the frame 170 includes two spaced-apart rails 171 and 174 that form a central opening for the marking filament 200. As discussed above, the base part 118 of the level device 115 can be slidably mounted relative to the frame on shoulders 172 and 173 of the rails 171 and 174, respectively, to allow the worker to position the level device 115 where it can most easily be viewed. Also, the level device 115 can be moved to the tip 120 of the line-marking device 100 to avoid interfering with a shuttle (discussed below) filled with a marking substance such as chalk when the shuttle is moved on the frame 170 to refresh the marking filament 200. The level device 115 can also be removably mounted to the frame 170. The frame may be made of any suitable material, e.g., metal or plastic. In FIG. 4, the marking filament 200 is shown in its nominal position in solid lines and in its raised position in broken lines during a marking operation. The underside of the rotatable part 116 has a recess 175 into which the marking filament 200 may move when it is raised during a marking operation, as discussed below in connection with FIGS. 12–16.

In use, the worker may position the line-marking device at a reference, e.g., the horizontal (indicated by an equilibrium state in the level 117). The line-marking device 100 is preferably activated to mark the reference, but need not be where the reference is horizontal. The worker then sets the rotatable part 116 at a desired angle, e.g., 45 degrees, and positions the line-marking device 100 against a wall in a position where the level 117 is again in an equilibrium state (or the noted bubble condition is reproduced where the reference is not horizontal). At this time, the marking filament 200, which extends in a central opening of the frame 170, is at the desired angle and the worker can mark a line at the desired angle, which intersects with, or can be extended to intersect with, the reference line. The frame 170 may have ruled markings, such as in inches and centimeters, which extend from the tip of the line-marking device.

In another embodiment, the function of the base part 118 is provided in an analogous structure that is part of the frame 170, e.g., in a raised or recessed region of the frame, rather than as a separate component. In this case, the level device 115 need include only one piece, namely the rotatable part 116, which can be attached to the frame by a friction joint, or other suitable device. Generally, the level device 115 includes at least one mark, such as a hash mark or angle markings, in a fixed relationship with the level 117, and at least one mark, such as angle markings or a hash mark, respectively, in a fixed relationship with the frame 170. The marks are positioned to cooperate to indicate an angular position of the marking filament when the level 117 is in an equilibrium state.

The invention also provides devices independent of the line-marking device that can be used to locate or measure an angular position with respect to a reference position using a rotatable level device 115. In one such embodiment, the rotatable level device 115 is attached to a member (e.g., a ruler, triangle, square, tool, etc., having a linear edge). In use, the angle is dialed from a reference location as discussed above, and then the member is pivoted until the level is in equilibrium, with a linear edge or tab or marking on the device to indicate the selected angle. In another such embodiment, two members, each with a linear edge, are pivoted together, e.g., at an end of each, and the level device 115 is attached to one of the members. In use, the two linear edges are pivoted to be parallel and aligned with a reference line. Then the rotatable part 116 is rotated to indicate the desired angle, and the member with the level device 115 pivoted until the level indicator (e.g., the bubble) is in the same configuration as in the reference position, e.g., in equilibrium when starting from a horizontal reference. This device can be used to replicate an angle by setting the rotatable level parallel to the linear edge of the member to which it is mounted, and then proceeding as described in connection with the following variation. In a variation of the device with two members, the level is not rotated in use, and the device can be used to find or replicate an angle. In this embodiment, the level may be mounted fixed and parallel to the linear edge of the member to which it is mounted, or rotatable, as described above, but not rotated in use. In use (if the level is rotatable, it is set parallel to the linear edge of the member to which it is mounted), the two members are pivoted so that they are parallel, and then the two linear edges are set parallel to one leg of the angle to be replicated. Then the member with the level is pivoted until the level indicates the horizontal. In this pivoted position, the member with the level forms the other leg of the angle and the device serves to replicate the angle.

As mentioned above, the member (besides the line-marking device) to which the rotatable level 115 can be attached can be a power tool such as a saw, sander, router, etc. For a power saw, the linear edge is the saw blade (or a linear edge parallel to the saw blade). For a power saw, the linear edge is the sanding plane of the sander (or a linear edge parallel thereto). The power saw can be set to saw at a selected angle or to make a selected angular cut, and a sander can be positioned to sand to a set angle. In the case of a power saw, the power saw can be positioned as described above for the line-marking device 100. Then, instead of snapping a line, the saw can be used to cut at the angle at which the saw is positioned. In the case of a sander, where, e.g., sanding is desired to finish an edge already cut at an angle, or to sand a corner to an angle, etc., the rotatable level is set to the desired angle, and the sander is then positioned on the work piece and worked until the work piece is sanded to the set angle. Use of the rotatable level with other power tools such as a router will be evident to those of skill in the art.

The tool to which the rotatable level 115 can be attached can also be a hand tool such as a triangle, square, tape or other distance measuring device, laser sighting device, etc. In the case of a square or triangle, one side of the triangle or square comprises the linear edge. Use of the rotatable level with these and other hand tools will be evident to those of skill in the art.

Figure 5:
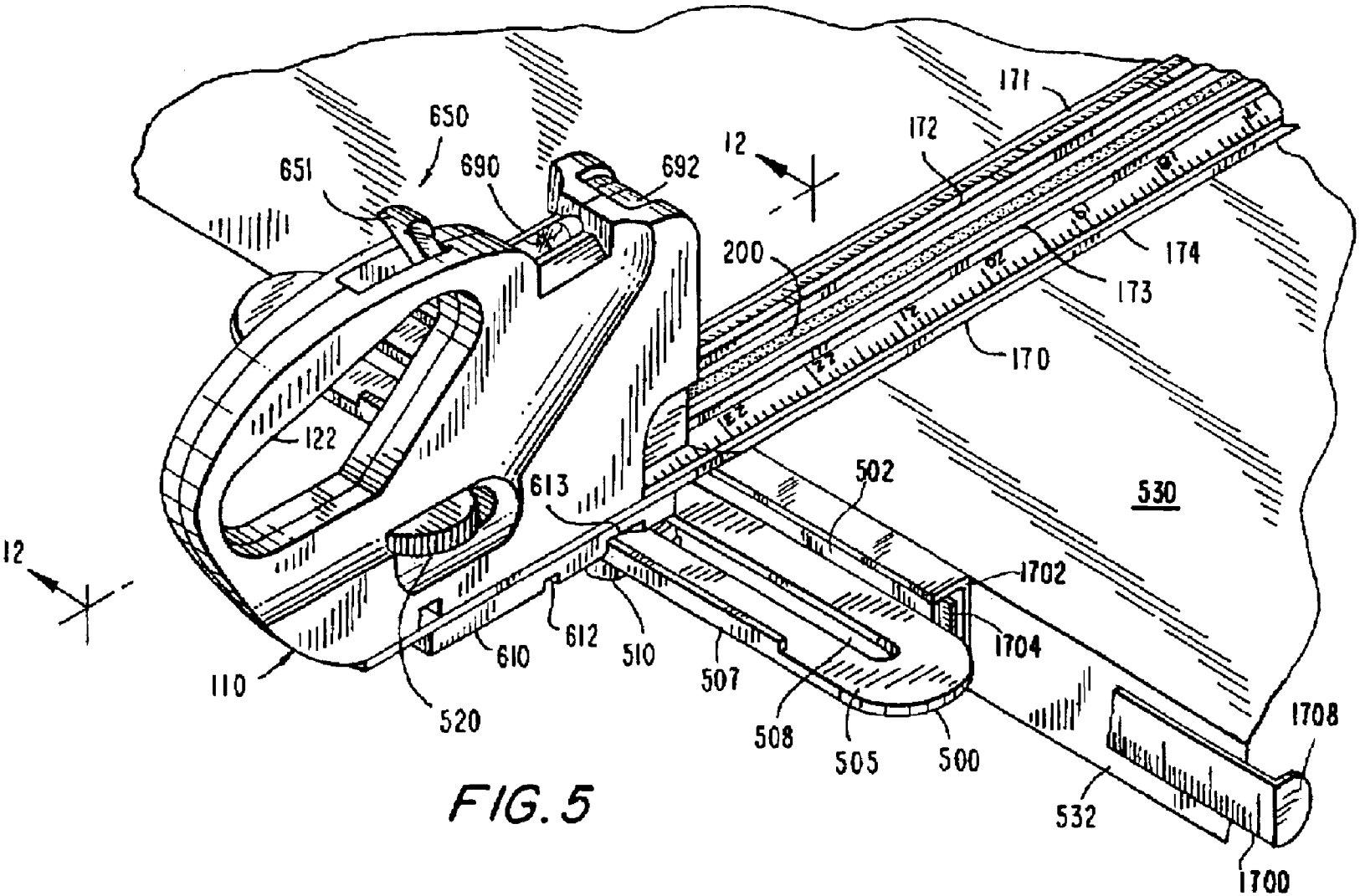
FIG. 5 is a perspective view of a line-marking device and attached guide bar in accordance with another embodiment of the invention.
Figure 12:
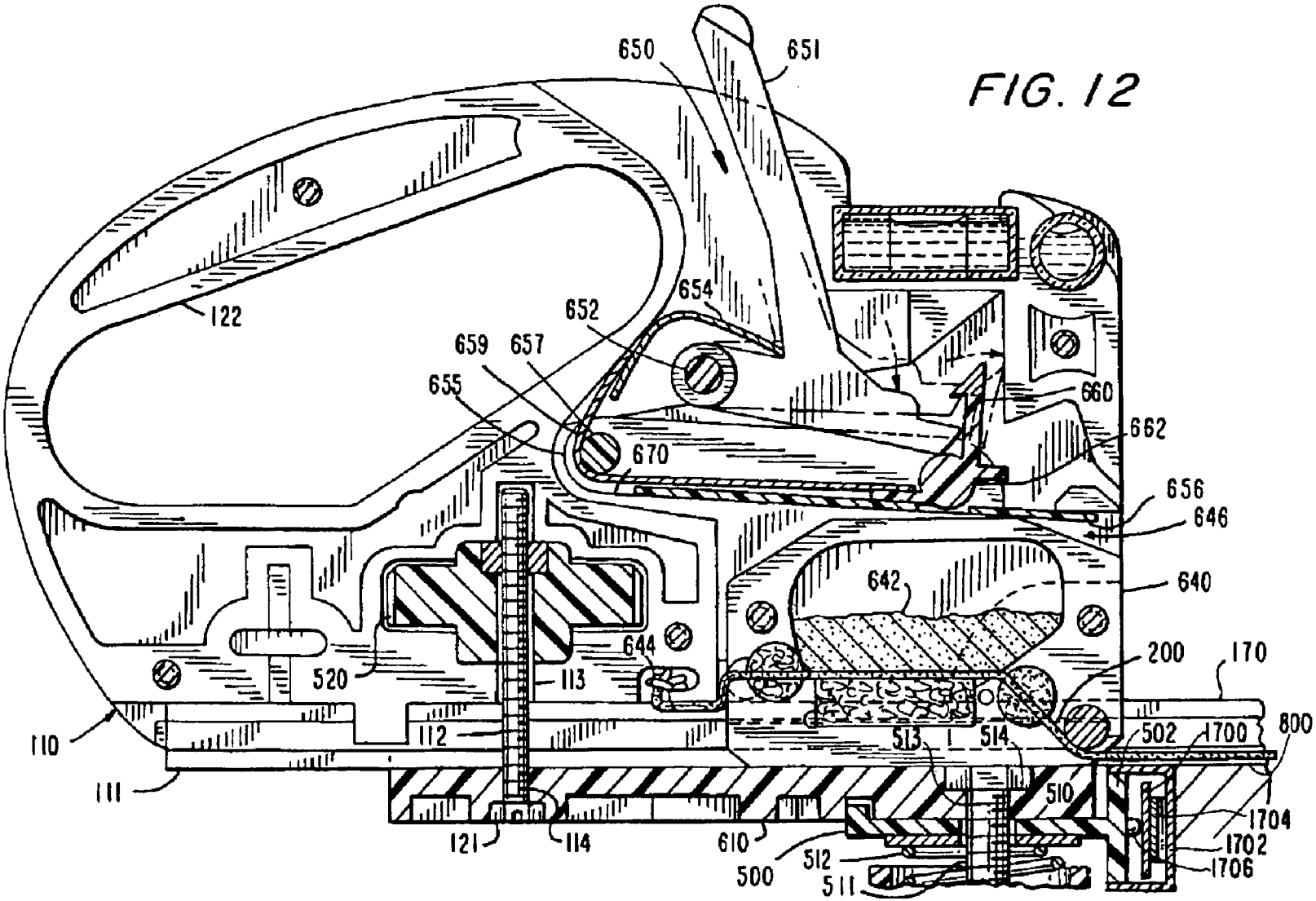
FIG. 12 is a cross-sectional view of the handle portion of the line-marking device depicted in FIG. 5 taken along line 12—12 of FIG. 5, showing a trigger device in accordance with another embodiment of the invention for snapping the marking filament of the marking device with the filament and parts of the trigger device in their nominal rest or home positions.

FIGS. 5–12 depict an embodiment of a line-marking device 100 with a guide bar 500 that can be used to position the line-marking device 100 at a desired angle relative to the edge 532 of a surface 530 to be marked. FIG. 5 shows an embodiment which includes a self-supporting member or strip 1700, described in more detail below, that can be used as a distance measuring device. The strip 1700 is mounted at the outer side of the front lip 502 of the guide bar 500 in a slot or channel 1702, shown in FIG. 12 in this embodiment. Other embodiments do not include the strip 1700 and the channel 1702, for example, see FIG. 13. When the channel 1702 is present, the channel 1702 rather than the front lip 502 of the guide bar contacts the edge of the surface 800 to be measured. See FIGS. 12 and 13, which show the line marking device abutting the edge of the surface 800 with and without the channel 1702, respectively. Only FIGS. 5 and 12 show the self-supporting strip 1700 and channel 1702, respectively. The discussion immediately below applies to embodiments that do not include the channel 1702. The embodiment with the channel 1702 is discussed further below.

Figure 6:
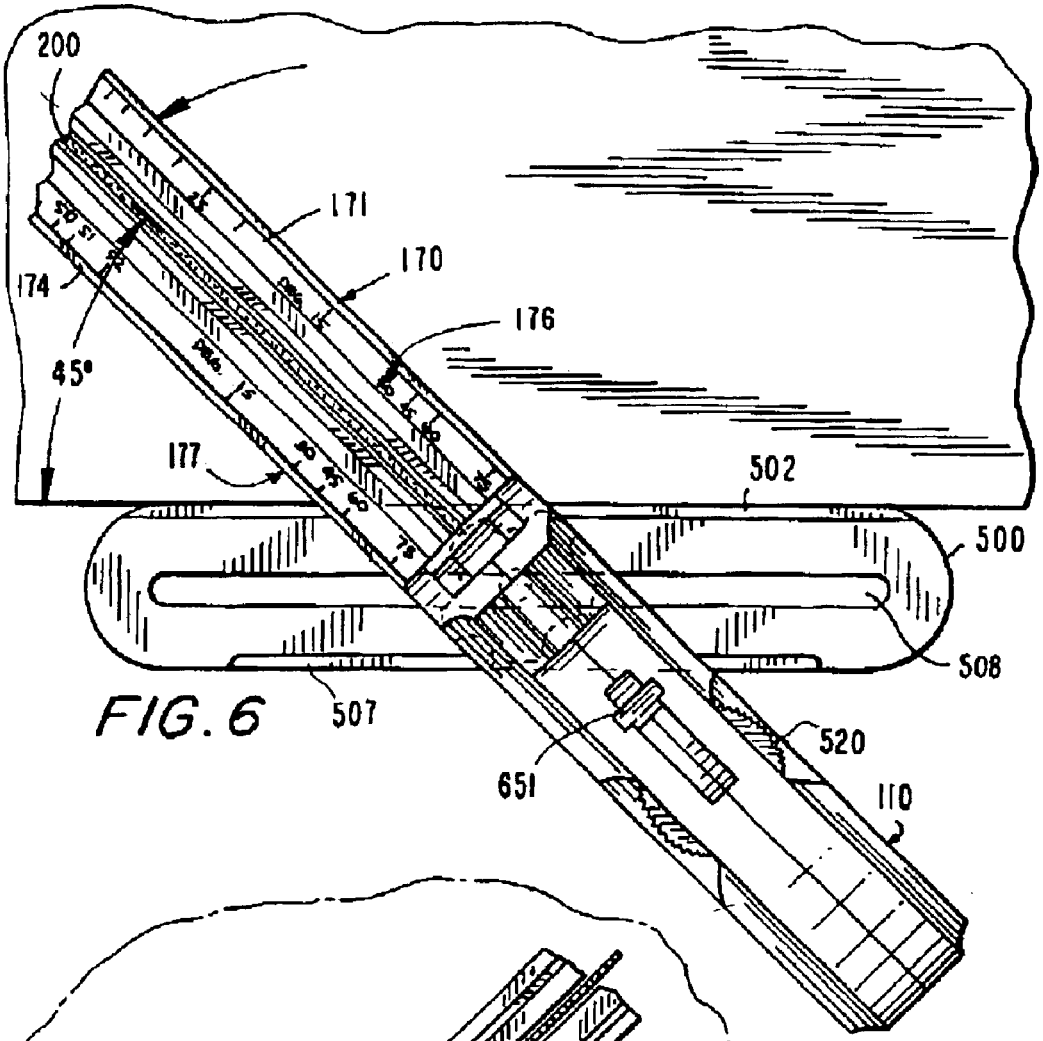
FIG. 6 is a top view of a portion of a line-marking device similar to the one depicted in FIG. 5, which also includes angle markings on the frame of the line-marking device and markings fixed relative to the frame which cooperate for use as protractor in accordance with another embodiment of the invention.
Figure 7:
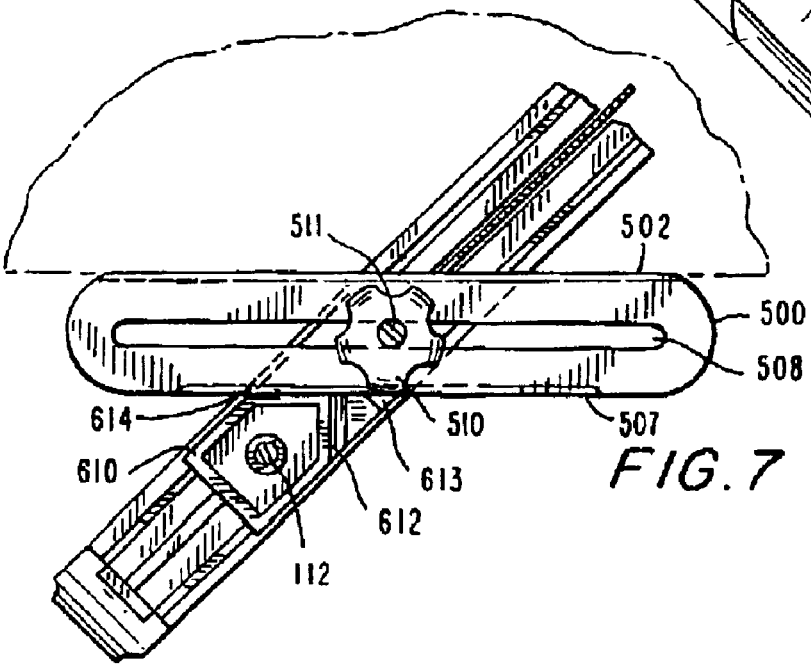
FIG. 7 is a bottom plan view of a portion of a line-marking device similar to the one depicted in FIG. 6, which also includes a detent mechanism for securing the guide bar in predetermined angular positions relative to the frame.
Figure 13:
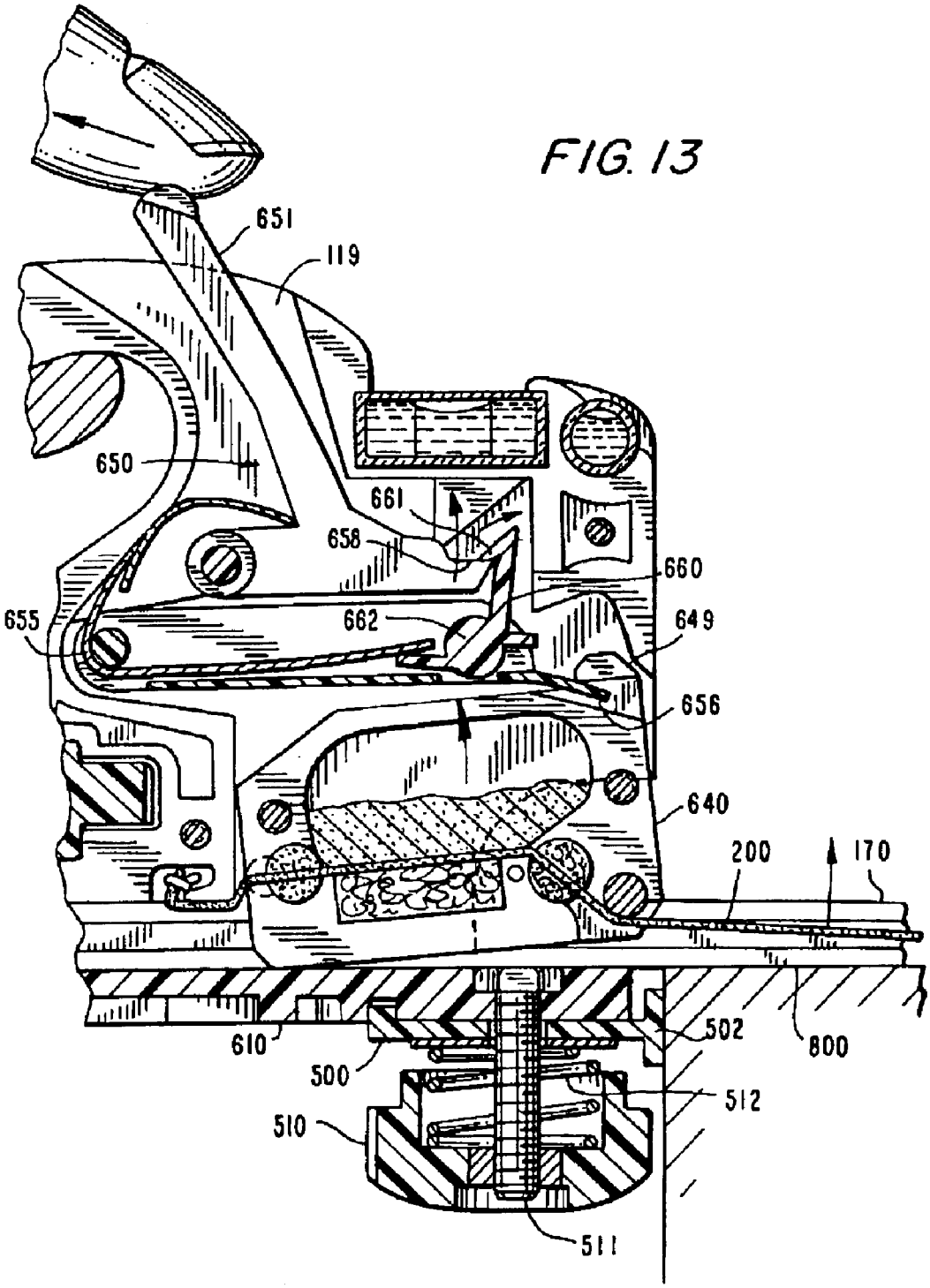
FIGS. 13 and 14 are cross-sectional views similar to that of FIG. 12 showing the positions of the filament and elements of the trigger device during a trigger actuation to snap the filament.

Referring to FIGS. 5 and 13, with a front lip or ridge 502 of the guide bar 500 abutting the edge 532 (shown in FIG. 5 to be 90 degrees and in FIGS. 6 and 7 to be 45 degrees and 135 degree respectively. In the embodiment depicted in FIG. 5, the filament 200 is at 90 degrees relative to the edge 532. The guide bar 500 is adjustably attached to a support plate 610 (FIG. 12) that is affixed to an underside of the handle 110.

Referring to FIG. 12, a spring 512 provides a force on the underside of the guide bar 500 to hold it firmly against the support plate 610. The spring 512 is held in place on a threaded shaft 511 by a knob 510 threaded onto the shaft 511. The spring force is adjusted by tightening or loosening the knob 510. The threaded shaft 511 passes through an aperture 513 in the support structure 610 and engages a threaded nut 514, which is seated in a nut-shaped recess in the support plate 610 so it cannot rotate. The worker repositions the guide bar 500 by pushing the handle 110 or guide bar 500 against the spring force while rotating the handle 110 or the guide bar 500 to the new desired position, and then releasing the handle or guide bar. However, the spring 512 need not be used, in which case the knob 510 is loosened and re-tightened to allow repositioning of the guide bar 500.

The guide bar 500 can be removed from the handle 110 so that the line-marking device 100 can be held flush against a surface to be marked, as illustrated in FIG. 1. In the embodiment depicted in FIGS. 5–12, the guide bar 500 is removably fastened to the handle 110 by removably fastening the support plate 610 to the handle 110 by a bolt 112 and knob 520 (FIG. 12). The knob 520 is attached to the threaded shaft of the bolt 112, which passes through an aperture 113 in the handle 110 and an aperture 114 in the support plate 610. The head 121 of the bolt 112 is seated in a recess in the support plate 610 so it cannot rotate while seated in the recess. The knob 520 can be rotated in a clockwise direction to tighten the support structure 610 to the handle 110, and rotated in a counter clockwise direction to release the support plate 610 from the handle 110. Interlocking or engaging structure may be provided on the top of the plate 610 and the bottom of the handle 110 to further prevent movement of the support plate 610 relative to the handle 110. Other means, such as quick-release mechanisms, may be used to removably secure the support plate to the handle.

In the embodiments depicted in FIGS. 5–13, the guide bar 500 is generally elongated with a central planar portion 505

(FIG. 5) having a slot 508 through which the shaft 511 of the knob 510 extends. (In the embodiment depicted in FIG. 12, the channel 1702 is provided on the outside of the front lip 502 of the guide bar 500.) Referring to FIGS. 5 and 7, detent mechanisms or stop mechanisms may be provided on the support plate 610 and guide bar 500 to hold the guide bar 500 in predetermined angular positions, e.g., in 45 degree or 30 degree increments, relative to the frame 170. For example, slots 612, 613 and 614 may be provided for holding a rear lip 507 of the guide bar 500 in predetermined angular positions. In conjunction with the spring-load adjustment knob 510 for the guide bar 500, these slots functions as detents. However, other suitable detent or stop structure may be used.

As shown in FIG. 5, with the rear lip 507 in the slot 613, the guide bar is at 90 degrees relative to the frame 170. As shown in FIG. 7, with the rear lip 507 in the slot 614, shown, the guide bar is at 45 degrees relative to the frame 170. With the rear lip 507 in the detent 613, (not shown) the guide bar would be at 135 degrees relative to the frame 170. A front lip 502 of the guide bar 500 extends above the guide bar 500, but may be extended only below the guide bar, or both above and below the guide bar, or may be eliminated. The rear lip 507 of the guide bar 500 extends above the guide bar 500 to engage the slots 612–614, as discussed above.

Referring to FIGS. 5 and 12–13, a shuttle 640 carries a marking material 642 (FIG. 12) such as chalk. The marking filament 200, e.g., a chalk line, extends through apertures in the shuttle 640 so that when the shuttle is moved back and forth on the frame 170, it deposits the marking material on the filament to refresh it. The shuttle 640 is then returned to its nominal (rest) position substantially within the handle 110, as shown in FIG. 12. Referring to FIGS. 4 and 5, the shuttle 640 includes structure that rides on, and engages the undersides of, shoulders 173 of rails 171, 174, respectively. In one embodiment, the shuttle 640 is provided with arms (not shown in the drawings) on its underside that engage the underside of shoulders 172 and 173. However, when the shuttle 640 is in its stowed position, it is not engaged by shoulders 172, 173 and may be raised during a trigger operation, as discussed below. Also, as discussed above, the level 115 may be moved to the end of the frame 170, or removed, when the shuttle 640 is to be moved to deposit marking material on the filament 200. Other suitable structures may be provided to retain the shuttle 640 as it travels back and forth on the frame 170 while also allowing the shuttle 640 to be pulled upward during a trigger operation. Also, in another embodiment, a frame may be provided with only one rail with the filament being carried on one side of the rail, and the shuttle sliding on and being retained by the single rail.

The handle 110 (FIGS. 5 and 12) includes a gripping portion 122, a trigger device or assembly 650 (discussed below), and spirit or bubble levels 690 and 692, which are provided in addition to, or instead of, the level 115 (FIG. 1). In the preferred embodiment, the handle 110 is aligned in the direction of the elongated frame. However, it is possible for the handle to be aligned perpendicular to the frame 170, or in some other orientation to facilitate use of the line-marking device in some applications. Such alignments may be executed in conjunction with features provided in other embodiments of the invention, e.g., an attached tape measure.

Referring to FIG. 6, a line-marking device 100 is provided with a protractor device 175 comprising angle markings 176, 177 on the rails 171, 174 of the frame 170. The protractor device 175 facilitates positioning the guide bar 500 at a desired angle relative to the frame 170. The frame 170 can be set to a desired angle by rotating the frame 170 relative to the guide bar 500 until the guide bar intersects the desired angle marking.

An angle can also be determined using the protractor device 175 by placing an edge of the frame 170 against one of the surfaces (or a reference on the surface) and an edge of the guide bar 500 against the other surface, then reading the angle from the particular angle marking 176 or 177 which intersects with the guide bar 500. The angle markings 176 and 177 may be read based on the position of the lip 502 or a hash mark (not shown) on the guide bar 500. In the embodiment shown in FIG. 6, the angular setting is 45 degrees. The angle markings 176 and 177 provide a non-linear scale since uniform linear increments on the rails 171 and 174 do not translate to uniform angular movements of the guide bar 500. The angle marking scale can be laid out using known mathematical relationships, templates or using other means, e.g., determining the angles empirically and calibrating the scale from the empirical angle determinations, that will be apparent to those skilled in the art. The angle markings 176 and 177 need only be provided on the portions of the rails 171 and 174 that are swept by the guide bar 500.

Thus, the protractor 175 can be used to set the filament 200 at a given angle with respect to the guide bar 500 or to measure an angle at which the frame is set relative to the guide bar. The protractor device 175 may also be used independently of snapping a line using a line-marking device, or as part of another device, to determine the angle of two joined surfaces, such as the edges of rafters, or to mark a desired angle. When the protractor is used alone, it may have two arms that are pivotably mounted to one another that are analogous to the guide bar 500 and frame 170. A first arm, e.g., analogous to the frame 170, has angle markings on an edge thereof that are swept, at least partly, by an edge of a second arm, e.g., analogous to the guide bar 500, and an angle between the two arms is indicated according to a relative position of the edge of the second arm to the angle markings on the first arm.

A rear lip need not be provided for the guide bar 500 in the embodiment depicted in FIG. 6, since the detents are not used and the rear lip might interfere with positioning of the guide bar 500. A common guide bar having a lip on one side only can be used in the different embodiments by flipping the guide bar over so that the lip becomes a rear lip for engaging the detents of the support structure when predetermined angular settings are desired, or the lip becomes a front lip when detents are not used, such as the embodiments shown in FIGS. 6 and 8.

The guide bar 500 (FIGS. 5 and 13) may also be used as part of an angle finder or replicator by reversing the plate 610 on the handle 110, i.e., rotating the plate by 180 degrees so that the guide bar is now at the opposite end of the handle 110 as compared to the position shown in FIGS. 4 and 13. A reference mark is preferably placed on the rear of the handle in alignment with the filament 200 (or a line of sight may be used from the rear of the handle to the filament, which may not be as precise for measuring an angle as reference mark). The reversed-position guide bar 500 and the reference mark on the line-marking device may be used to find and replicate an angle finder as follows. The angle to be replicated is found by aligning the reference mark with one leg of the angle, the guide bar 500 and positioning guide bar 500 in alignment with the other leg of the triangle (by loosening knob 510, pivoting the guide bar 500 to the aligned position, and then retightening the knob 510). Then, the position of the plate 610 is reversed back to the position shown in FIGS. 4 and 13 without changing the pivoted position of the guide bar. This procedure may provide the complement of the angle to be replicated, as will be evident to tradesman and consumers of the type likely to use the marking device 100, unless, for example, the marking device 100 is turned over between finding the angle and positioning the marking device 100 to replicate the found angle so a line can be applied by the marking device 10 at the replicated angle. Alternatively, if a protractor is stamped on the pivoting end of the guide bar, then the angle so found can be noted, and then replicated as described above in connection with the protractor device 175. As discussed above, the guide bar 500 is mounted under pressure of a spring load (spring 512 in FIG. 13), so that the formed angle is maintained until the holding knob 510 (FIG. 5) can be tightened to secure the positions of the guide bar and the handle relative to each other.

FIGS. 8 and 9 illustrate an embodiment of a line-marking device that includes a protractor 810. As an alternative to the use of the protractor 175 in the embodiment depicted in FIG. 6, the protractor 810 may be mounted on the line-marking device to indicate an angular position of the frame 170 relative to the surface to be marked and the guide bar 500. The protractor 810 has angle markings along its periphery, and is removably secured in a fixed relationship to the guide bar 500, for example, by a threaded shaft 511 and knob 510. An angular reading is made based on the relative position of the angle markings on the protractor 810 and hash marks 820 and 822 carried on opposite sides of the handle 110. As shown in FIG. 8, the protractor 810 is read at the hash mark 820, which indicates an angular setting of 45 degrees. The protractor 810 may be made of plastic, metal or other material similar to or different from the material of which the guide bar 500 is made, and may be shaped with a straight edge that abuts the front lip 502 of the guide bar 500 so that the protractor 810 rotates with the guide bar 500. Other variations are possible, such as having the protractor rotate with the handle 110, and having hash marks on the guide bar 500. The protractor 810 is removably positionable between the guide bar 500 and the elongated frame so that it can be easily inserted or removed by detaching the knob 510 and removing the protractor from the shaft 511.

In another embodiment depicted in FIGS. 10 and 11, a protractor 810*a* may be permanently attached to or provided integral (i.e., unitary) with the guide bar 500. For example, the protractor 810*a* may be printed, engraved, stamped or otherwise applied to a disc or decal permanently affixed to the guide bar 500, or printed, engraved, stamped, etc., directly to the guide bar 500.

In another embodiment (not shown), the protractor 810*a* depicted in FIG. 11 is positioned at an end of the guide bar 500. To use the protractor in this embodiment, the guide bar 500 is moved until the shaft 513 is at the end of the slot 508, and therefore at the center of the protractor. Positioning the protractor 810*a* at the end of the guide bar 500 may facilitate use in some applications. In this embodiment, a boss is preferably provided concentric with shaft 511, and a complementary recess at each end of the slot in the center of the protractor located at the end of the guide bar, to ensure that, in use, the shaft 511 is seated at the center of the protractor.

The handle 110 (FIGS. 5 and 12) includes a gripping portion 122 and a trigger device or assembly 650. As shown in FIGS. 12–18, the trigger device 650 includes a manually actuatable trigger device 650 that includes a trigger lever 651. The trigger lever 651 pivots relative to the handle 110 about a pin 652 and is biased forward (towards the end of frame 170) in the handle 110 by a leaf spring 654. A lifter arm 655 having a bottom portion 670 and opposing sidewalls pivots relative to the handle 110 about a pin 657. A leaf spring 659 biases the lifter arm 655 downward. A rocker arm 660 is carried by the lifter arm 655 and pivots relative to the lifter arm 655 about a pin 662. The leaf spring 659 also biases the rocker arm 660 rearward. A tab 656 of the lifter arm 655 projects into a recess or slot 646 of the shuttle 640 when the shuttle 640 is in the stowed position depicted in FIG. 12. The marking filament 200 is routed through apertures in the shuttle 640 so that it communicates with the marking substance 642 and terminates at a terminal point 644 in the handle 110. Preferably, the terminal point 644 can be easily reached so that the marking filament 200 can be replaced when it wears out. The various components of the trigger device may be formed from suitable materials such as plastic or metal, for example. Alternatively, the trigger lever 651 is biased forward, and the trigger actuated backward with an index finger.

Operation of the trigger device 650 is the same with and without the guide bar 500 and support plate 610 attached. (In FIG. 12, the guide bar 500 is set so that a line can be marked on a surface 800 at a specific angle, e.g., 90 degrees.) Referring to FIG. 12, as the trigger lever 651 is moved rearward (counterclockwise in FIG. 12) from the forward wall of slot 119, which functions as a stop, a tip 658 of the trigger lever 651 engages a shoulder 661 of the rocker arm 660. As shown in FIG. 13, further movement of the trigger lever 651 raises the rocker arm 660. Since the pin 662 of the rocker arm 660 is carried by the lifter arm 655, the lifter arm 655 and the tab 656 are also raised. The tab 656 in turn raises still the shuttle 640 via its shoulder 656. This upward movement of the shuttle 640 pulls the marking filament 200 away from its nominal position in the frame 170.

Figures 14, 15:
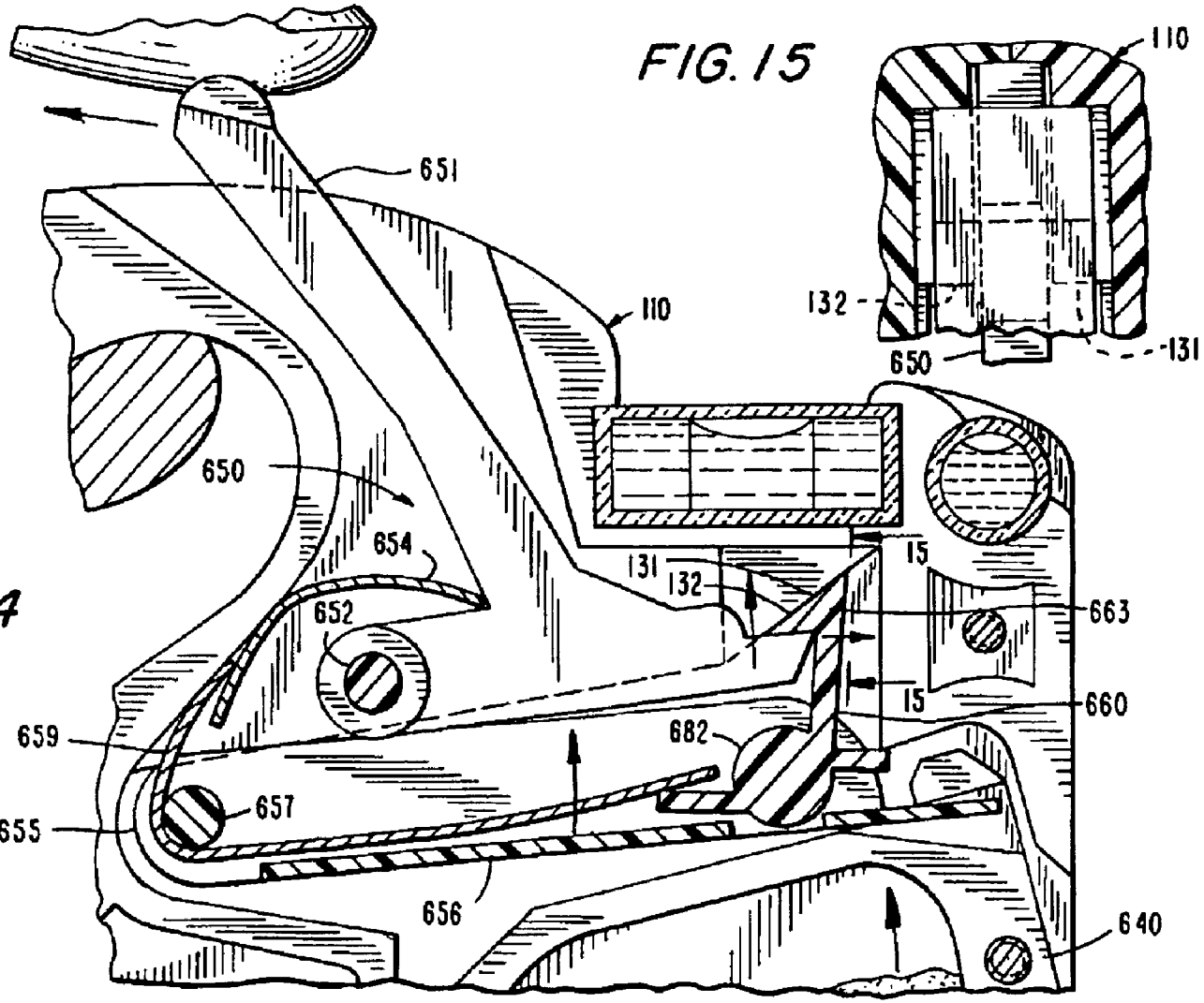
FIG. 15 is a partial cross-sectional view of the trigger device and handle of FIG. 5 taken along lines 15—15 of FIG. 14.

Referring to FIG. 14, as the rocker arm 660 is raised still further by rearward movement of the trigger lever 651, the sloped cam surface 663 of the rocker arm 660 contacts sloped spaced-apart cam surfaces 131 and 132. The cam surface 663 of the rocker arm 660 is wider than the trigger lever 650 to allow the trigger component 650 to rotate between the sloping cam surfaces 131 and 132 upon further backward pivoting of the trigger lever 651.

Referring to FIG. 16, still further rearward pivoting of the trigger lever 651 causes the rocker arm 660 to be cammed forwardly along the cam surfaces 131, 132 and the cam surface 663 of the rocker arm 660 to slide along the spaced-apart cam surfaces 131 and 132 until the tip 658 of the trigger level moves past the shoulder 661, which is the release position. In the release position, shown in broken lines in FIG. 12, the tip 658 of the trigger component 650 disengages from the shoulder 661 of the rocker arm 660. At this time, the spring energy of the leaf spring 659 causes the rocker arm 660, lifter arm 655, lifting tab 656, shuttle 640 to revert to their nominal home positions and for the marking filament to snap back to its nominal home position. As a result, the marking filament snaps down on the surface to be marked and deposits the marking substance thereon. Thus, the leaf spring 659 is loaded when the trigger component 650 is pulled back from its nominal position toward the release position. When the release position is reached, the spring is unloaded to cause the marking filament 200 to snap back to its nominal position.

Referring to FIG. 4, the marking filament 200 is shown in its nominal position in solid lines and in its raised position, e.g., the release position, in broken lines. After the marking filament 200 snaps back to its nominal position, the worker may release the trigger component 650 to allow it to return to its nominal position under the force of the leaf spring 654. The trigger component 650 can be actuated repeatedly to make repeated lines.

FIG. 17 illustrates the movement of the trigger assembly of the line-marking device 100 which causes the shuttle 640 to move along the elongated frame 170 providing a marking substance, such as chalk, to the marking filament 200 for transfer to a surface when the marking filament 200 is snapped.

In practice, the line-marking device can be easily used by novices and professionals, as well as people with different hand strengths and flexibilities, to mark multiple lines of consistent darkness by moving the manually operable trigger lever 651 rearward with a finger or thumb. After one line has been made, the line-marking device can be quickly repositioned to mark another line quickly and effortlessly. Since the marking filament is raised above its nominal position each time to the same height and with the same spring energy, it will snap back with the same force, resulting in consistent, high quality lines. The height and spring energy can be set based on factors such as the weight, length and type of the marking filament and marking substance. For example, a greater height and spring force may be used for a longer or heavier marking filament. While a specific design has been shown, those skilled in the art will appreciate that the functionality described may be achieved using various components. For example, the trigger lever 651 may be fashioned as a push button or like the trigger on a gun. It is also possible to provide electrically actuatable components to provide the functionality described. Also, a trigger device may be developed to raise and release the marking filament directly rather than via the shuttle.

Figure 18:
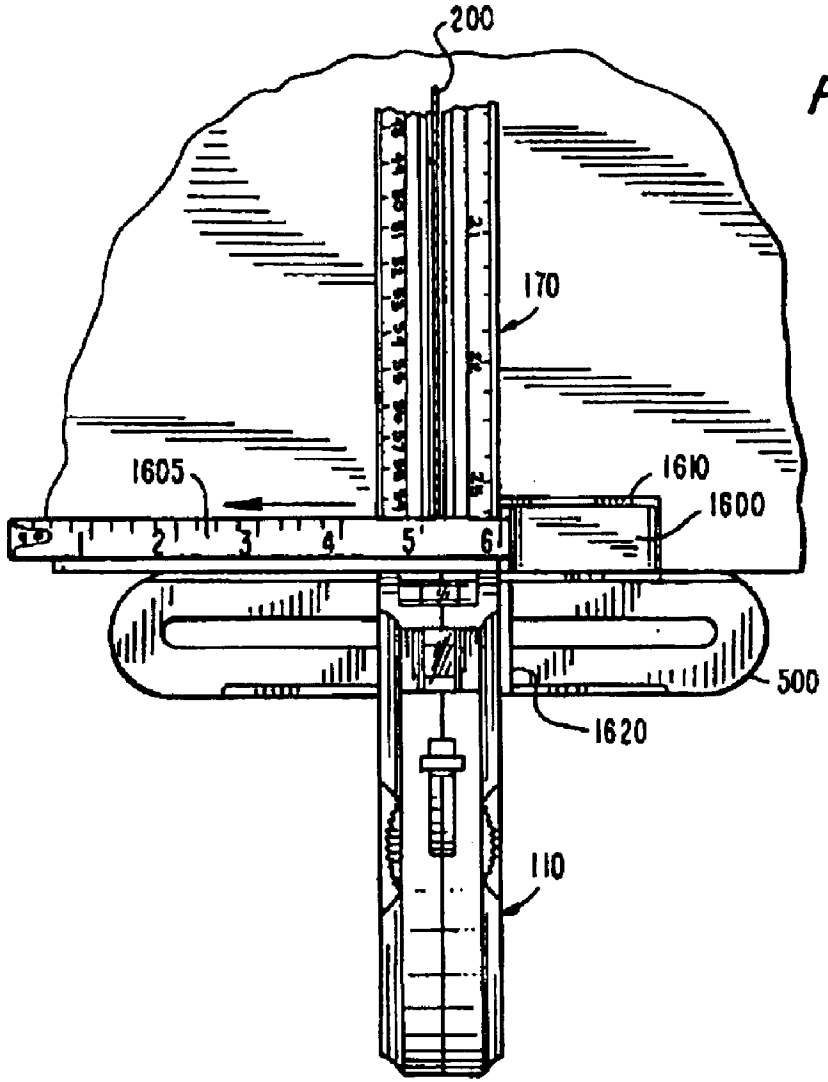
FIG. 18 is a top view of a portion of a line-marking device with a retractable tape measure in accordance with another embodiment of the invention.

Referring to FIG. 18, a line-marking device 100 is provided with a retractable tape measure 1500 for measuring variable distances from the marking filament 200 by extending the tape 1605. The tape measure 1500 may itself be conventional and include means for selectively holding the tape in an extended position. A holder 1610 for the tape measure 1500 may be secured to the handle 110 using an L-shaped bracket 1620, for example, or integrated into the handle itself, e.g., as part of the molding process for the handle parts. In another embodiment, the tape measure 1500 may be directly attached to the handle. The holder 1610 may be made of plastic or metal, for example, and sized to house a conventional tape measure. The holder 1610 may be basket-shaped with an opening at a corner for the tape to pass through when extended, and configured to allow the tape measure 1500 to be easily inserted and removed. The tape measure 1500 is held so that the tape 1605 can be extended in a predetermined relationship to the frame 170 and marking filament 200. For example, the tape measure may be held by the holder 1610 so that the extension of the tape 1605 is substantially perpendicular to the marking filament 200, in which case the tape can be used to measure a distance that is perpendicular to the marking filament 200. In the embodiment depicted in FIG. 18, the tape 1605 extends over the frame 170. However, the tape 1065 can be extended under the frame 170 through a slot or channel (not shown) therein in a manner that does not interfere with movement of the filament 200 during a marking operation.

In the embodiment depicted in FIG. 18, the end of the tape is at a distance of about 5¼ inches from the filament 200. The reading on the tape 1605 is taken by viewing the line-marking device from above. A marking device 100 with a tape measure 100 can be used to mark a line a given distance from a reference point such as the end of a wall panel, or when multiple parallel lines need to be marked at a constant or other specified distance from one another using only one hand. Other measuring devices such as a self-supporting, e.g., rigid, member 1700 bearing a distance scale or notation (in English or Metric System) may be removably attached for this purpose, as shown, for example, in FIGS. 5 and 12. (As discussed above, this embodiment is illustrated only in FIGS. 5 and 12.) In this embodiment, the self-supporting member or strip 1700 may be displaced, i.e., extended, in a channel 1702 (shown in FIG. 12) on the outer surface of the edge 502 of the guide bar 500. The channel 1702 extends for a substantial distance, e.g., approximately the length of the front lip 502 of the guide bar 500, so that the line-marking device 100 does not rock or pivot about the channel when the channel is against the edge of the surface 530 to be marked as shown in FIG. 12. The channel 1702 is preferably constructed so as, or provided with means, to provide frictional engagement of the self-supporting strip 1700 therein so that the self-supporting strip is maintained in the position to which it has been moved. For example, as shown in FIG. 12, a leaf spring 1704 is provided extending, e.g., longitudinally in the channel 1702, and one or more projections 1706 of suitable shape, e.g., hemispherical, are provided opposite the leaf spring 1704 to frictionally engage the self-supporting strip 1700 therebetween, The self-supporting strip 1700 may be provided with a tab 1708 at one end to abut the edge of the surface 530 to be measured during a measurement, in order to facilitate quick and easy repetitive markings. In another embodiment, the self-supporting strip is mounted to be displaceable parallel to the filament by suitable structure, through which the strip is displaceable, mounted to the side or an end of the frame. The strip 1700 may be made of any suitable material, e.g., metal, plastic, wood.

In another embodiment (not shown), the holder 1610 may be positioned so that the tape 1605 extends substantially parallel to the elongated frame 170. For example, the holder 1610 may be secured alongside the handle 110 using any appropriate fasteners and/or brackets. This may be useful, e.g., in measuring a distance from the guide bar 500. Structure may also be provided for pivoting the holder 1610 to position it perpendicular or parallel to the frame 170, or in other relative positions.

While the invention has been described and illustrated in connection with preferred embodiments, many variations and modifications as will be evident to those skilled in this art may be made without departing from the spirit and scope of the invention, and the invention is thus not to be limited to the precise details of methodology or construction set forth above as such variations and modification are intended to be included within the scope of the invention.

What is claimed is:

1. In a line-marking device including an elongated frame and a marking filament that is held taut by the elongated frame, the improvement comprising:

a manually operable trigger device comprising a manually operable trigger movable from a nominal position to a release position to pull at least a portion of the marking filament away from a nominal position and release the marking filament to snap back to its nominal position when the trigger reaches its release position.

2. A line-marking device, comprising:

an elongated frame;

a marking filament held taut by the elongated frame;

a manually operable trigger movable from a nominal position to a release position; and means for coupling the trigger to the marking filament to enable the trigger to pull at least a portion of the marking filament away from a nominal position and release the marking filament to snap back to its nominal position when the trigger reaches its release position in response to manual actuation.

3. A line-marking device, comprising:

an elongated frame;

a marking filament held taut by the elongated frame;

a shuttle through which the marking filament extends;

a manually operable trigger movable from a nominal position to a release position; and means for coupling the trigger to the shuttle to enable the trigger to pull the shuttle and at least a portion of the marking filament away from respective nominal positions and release the shuttle and marking filament to snap back to their respective nominal positions when the trigger reaches its release position in response to manual actuation.

4. The line-marking device of claim 3, wherein the coupling means comprises at least one arm that engages the shuttle and that is lifted by the trigger when it is moved from the nominal position thereof to the release position thereof.

5. The line-marking device of claim 4, wherein:

the shuttle carries a marking substance therein, and is moveable on the elongated frame to deposit the marking substance on the marking filament; and the at least one arm engages the shuttle when it is in a nominal position within a handle that is secured to the elongated frame.

6. In a line-marking device including an elongated frame and a marking filament that is held taut by the elongated frame, the improvement comprising:

a manually operable trigger device comprising a manually operable trigger movable from a nominal position to a release position to pull at least a portion of the marking filament away from a nominal position and automatically release the marking filament to snap back to its nominal position when the trigger reaches its release position.

7. In a line-marking device including an elongated frame and a marking filament that is held taut by the elongated frame, the improvement comprising:

a manually operable trigger device comprising a manually operable trigger movable from a nominal position to and through a release position to pull at least a portion of the marking filament away from a nominal position and automatically release the marking filament to snap back to its nominal position when the trigger reaches its release position.

8. A line-marking device, comprising:

an elongated frame;

a handle attached to the elongated frame;

a marking filament held taut by the elongated frame;

a shuttle slidably mounted to the frame and into which the marking filament extends;

a manually operable trigger comprising a trigger lever pivotally mounted to the handle pivotable between a nominal position and a release position and a mechanical coupling movable by the trigger lever to move the shuttle such that pivoting of the trigger lever from the nominal position towards the release position thereof moves the shuttle and at least a portion of the marking filament away from respective nominal positions thereof and such that movement of the trigger lever to the release position thereof releases the shuttle and the at least a portion of the marking filament to snap the at least a portion of the marking filament back to its nominal position.

* * * * *